United States Patent [19]

Baker

[11] 4,372,393

[45] Feb. 8, 1983

[54] CASING BORE RECEPTACLE

[75] Inventor: John R. Baker, Houston, Tex.

[73] Assignee: Baker International Corporation, Orange, Calif.

[21] Appl. No.: 273,805

[22] Filed: Jun. 16, 1981

[51] Int. Cl.[3] ..... E21B 23/02; E21B 33/129; E21B 43/00

[52] U.S. Cl. ..... 166/382; 166/138; 166/217; 166/387

[58] Field of Search ..... 166/138, 173, 216, 217, 166/315, 382, 387

[56] References Cited

U.S. PATENT DOCUMENTS

| | | | |
|---|---|---|---|
| 2,506,680 | 5/1950 | Otis | 166/217 X |
| 2,862,560 | 12/1958 | Bostock et al. | 166/217 X |
| 2,948,338 | 8/1960 | Raulins et al. | 166/123 |
| 2,975,836 | 3/1961 | Brown | 166/217 X |
| 3,002,565 | 10/1961 | Moore, Jr. | 166/217 |
| 3,109,490 | 11/1963 | Baker | 166/114 |
| 3,126,059 | 3/1964 | Fredo | 166/217 X |
| 3,443,638 | 5/1969 | Haynie | 166/315 X |
| 3,459,260 | 8/1969 | Dollison | 166/216 X |
| 3,507,329 | 4/1970 | Stone, Jr. | 166/217 X |
| 3,920,075 | 11/1975 | Braddick et al. | 166/290 |

OTHER PUBLICATIONS

Page 6438 and 6439-vol. 4-of the 1978-1979 Composite Catalog of Oil Field Equipment & Services-33rd Revision-published by World Oil.

Page 672-vol. 1-of the 1980-1981 Composite Catalog of Oil Field Equipment & Services-34th Revision-published by World Oil.

*Primary Examiner*—William F. Pate, III
*Assistant Examiner*—George A. Suchfield
*Attorney, Agent, or Firm*—William C. Norvell, Jr.; Robert W. Pitts

[57] ABSTRACT

A sealing assembly comprising a casing bore receptacle, an annular packoff member, and a tubing carried mandrel for use in establishing sealing integrity between a fluid transmission conduit or tubing and an outer conduit or casing, is disclosed. The casing bore receptacle is incorporable in the casing and the annular packoff member is initially carriable on the mandrel. Seals on the interior and exterior of the packoff member establish a seal with the mandrel and the casing. Upon abutting engagement of the packoff member and the casing bore receptacle, a collet on the packoff member is released from the mandrel and cammed radially outward into engagement with the casing bore receptacle to anchor the packoff member to the casing bore receptacle. The mandrel can then move relative to the packoff member and the casing without destroying the seal.

32 Claims, 7 Drawing Figures

CASING BORE RECEPTACLE

BACKGROUND OF THE INVENTION

1. Field of the Invention

This invention relates to sealing and packing systems used in subterranean oil and gas wells for providing an annular seal between a fluid transmission conduit disposed in another conduit, the most common example being to provide an annular seal between production tubing and casing.

2. Description of the Prior Art

There are many different downhole tools in the oil and gas industry which require that a seal be established in the annulus between a fluid transmission conduit or tubing string disposed in a well bore and the outer well casing. These tools may relate to the drilling and completion of the well, the production of the well, the servicing of the well, or the abandonment of the well. Conventional packers, employing an anchoring system for holding a sealing element in position against either upwardly or downwardly acting pressure differentials, are most often employed for establishing this seal. These conventional packers generally employ radially expandable anchor slip systems and radially expandable packing or sealing elements to prevent fluid communication and to provide pressure integrity. Such packers are typically run in and set in place either by or on a tubing string or a wireline setting tool. When set using a tubing string, the packer is typically set using hydraulic pressure in the tubing, hydrostatic pressure in the well bore, or a combination of both. It may also be mechanically set by the weight of the tubing. These packers can be permanent type packers with an internal seal bore for receiving tubing which can be retrieved while leaving the packer in place. Retrievable packers, employing techniques such as rotary manipulation of the tubing string to release anchor slip assemblies and packing elements for retrieval of the packing element, are also commonly employed.

It is generally necessary that sealing integrity be established between separate elements within the tubing string or between accessory items and the tubing string. For example, it is generally necessary that tubing sections, inserted into a seal bore of a packer, must have sealing integrity between that section and the packer. One means of providing such sealing integrity is to utilize stacks of sealing elements in which individual sealing elements have a generally chevron-shaped cross section. Sealing systems employing such chevron-shaped sealing elements are depicted on page 672 of the 1980–81 Composite Catalog of Oilfield Equipment and Services published by World Oil. These chevron-shaped sealing elements and systems, commonly referred to as tubing seal systems, are generally employed to establish a seal between a tubing mounted element and the internal seal bore of a conventional packer. An alternative method of establishing a seal between a conventional packer and tubing elements while still permitting movement of the tubing elements relative to the packer, is depicted in U.S. Pat. No. 3,109,490 covering a slidable latching seal assembly.

In addition to the use of conventional packing elements to provide sealing integrity in the tubing casing annulus and to isolate the production zone from portions of the annulus extending above the packing element, casing polished bore receptacles have been employed in conjunction with sealing elements to achieve some of the objectives achieved by conventional packers. A typical prior art example of the use of packoff assemblies in conjunction with casing bore receptacles, or liners, is discussed on pages 6438 and 6439 of the 1978–79 Composite Catalog of Oilfield Equipment and Services published by World Oil.

The present invention provides a packoff assembly which can be used in conjunction with a casing bore receptacle and a tubing mounted mandrel to provide a tubing-casing annular seal and to permit isolation of the production zone from the tubing-casing annulus. This invention employs a latchable packoff assembly which can be positioned at a precise location in the casing and which will permit tubing movement which may result during a production or treating cycle. Tubing movement is especially significant in deep hot wells. In deep hot wells the tubing is originally landed at more or less an ambient well temperature. During treating operations, for example, if a cold acid is pumped down the tubing, the tubing would tend to undergo contraction. The tubing will elongate if heated by produced fluids. Some means for permitting tubing movement must therefore be provided. Tubing may tend to shrink because of a balooning effect or as a result of helical buckling. The tubing may also be subjected to a compressive force, sometimes referred to as "piston effect", tending to shorten the tubing. This force is due to differential pressure acting on the end area of the tubing and that portion of a packoff assembly extending between the tubing and casing. The present invention provides a means for attaching the tubing casing packoff assembly to the casing, thus eliminating any piston effect. By attaching the packoff assembly directly to the casing receptacle, the only force acting on the tubing would be that force developed by the pressure differential acting on the cross-sectional area of the tubing itself.

This invention also permits the use of tubing seal systems to accomplish the sealing function otherwise achieved by the use of conventional radially expanding packing elements. With this invention, the cross-sectional area or gap across which the sealing elements must bridge is much less than that encountered when conventional packing elements are used. Significant radial expansion of the sealing elements themselves is therefore eliminated. Conventional radially expanding packing elements generally require a complex means of expanding the packing element into and maintaining it in sealing engagement with the surface to be sealed. This means is sometimes further complicated by the necessity of providing expanding packing element retaining means to prevent extrusion of the packing element through the gap that it must bridge. On the other hand, the elements of tubing seal systems are energized by the pressure which they contain. They therefore need no mechanism to expand them and since the metal elements that retain them fit the sealing surface closely, there can be a very small gap that the seals must bridge. Contraction of the packoff assembly using a tubing seal system is, therefore, much more simple than one using conventional radially expanding packing elements. This invention, therefore, provides a means for using tubing mounted seals instead of conventional packing elements in deep hot wells under hostile environmental conditions. This invention also permits the use of tubing elements having a relatively large cross-sectional area, thereby permitting high volume production rates.

SUMMARY OF THE INVENTION

This sealing assembly for establishing sealing integrity in the annular area between a movable fluid transmission conduit and the casing of a subterranean well above a production zone comprises a casing bore receptacle, an annular packoff member, and a mandrel. The casing bore receptacle is incorporable in the casing and in the preferred embodiment has a polished bore with a diameter slightly less than the diameter of the casing. Upper and lower shoulders are located on opposite ends of the polished bore. The annular packoff member has circumferential chevron-shaped sealing elements on its inner and outer axial surfaces extending between an upper annular shoulder and a lower releasable collet. The packoff member is carriable on a mandrel which is incorporable on a tubing string. Upon engagement of the packoff annular shoulder with the upper casing bore receptacle shoulder, continued movement of the mandrel will release the collet and cam the collet outwardly for engagement with the lower casing bore receptacle shoulder. The chevron-shaped seals then establish sealing integrity while permitting the mandrel and the tubing string to move relative to the packoff member and the casing.

DESCRIPTION OF THE PREFERRED EMBODIMENTS

Figure 1A:
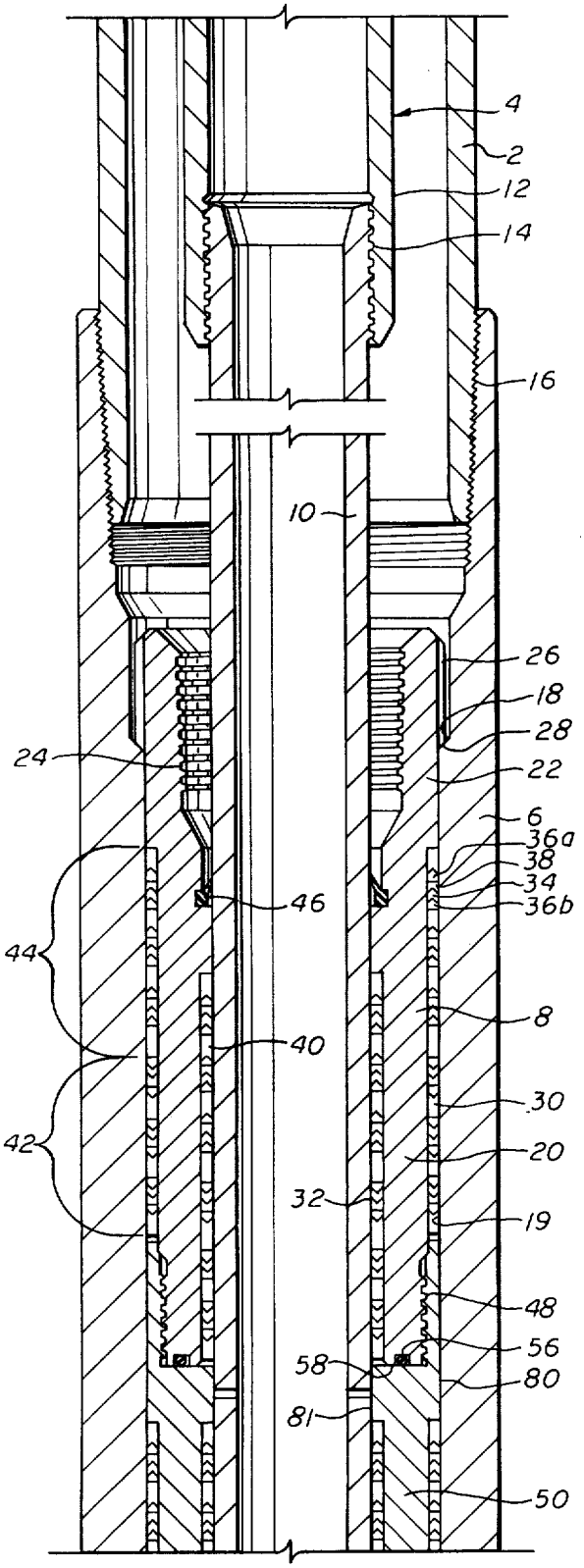
FIG. 1 is divided into two sections (FIG. 1A and 1B) which consists of longitudinal sections depicting the casing bore receptacle, the packoff member, and the mandrel, all positioned prior to engagement of the packoff member with the casing bore receptacle.

The seal assembly provided by the preferred embodiments of this invention provides a means for isolating the annular area between an oil well casing and a tubing string or fluid transmission conduit 4 and the production zone (not shown). This annular area extends above the production zone and isolation is provided by means of the interaction between a casing bore receptacle 6, which comprises an integral part of the casing, and a packoff member 8 initially carried on a mandrel 10. Mandrel 10 is carried as an integral part of tubing string 4 and is attached to the tubing 4 by means of a coupling 12 and threaded connections 14. The packoff member 8 employs seal stacks on the inner and outer cylindrical surfaces to establish sealing integrity between the casing bore receptacle 6, the packoff member 8, and between packoff member 8 and mandrel 10.

Casing polished bore receptacle 6 is incorporated in casing 2 when the casing is first installed in a subterranean oil or gas well. Producing zones would be identified prior to installation of casing 2 and, in the preferred embodiment of this invention, a casing bore receptacle 6 could be installed just above the producing zone. Casing bore receptacle 6 is attached to casing 2 by means of threaded connection 16 at its upper end. A similar threaded connection 140 is located at the lower end of the casing bore receptacle and provides similar attachment to those portions of casing 2 extending below the casing bore receptacle. An upwardly facing shoulder or first stop 18 is located on the inner surface of casing bore receptacle 6 just below threaded connection 16. This upwardly facing shoulder is commonly referred to in the art as a no-go shoulder. A downwardly facing shoulder or second stop 76 is located adjacent lower threaded connections 140 near the bottom of casing bore receptacle 6. The surface 80 extending between shoulders 28 and 76 has a fine finish and would provide a sealing surface against which seals on packoff member 8 could act to form an appropriate seal. The inner diameter of polished bore 80 is less than the normal inner diameter of casing 2. However, this reduction in the diameter of the casing need not be large and would not appreciably change the cross-sectional area of the casing.

At the point at which it becomes necessary to insert a fluid transmission conduit or production tubing 4 and to isolate the production zones from the casing by preventing communication of produced fluids between the production zones and the tubing casing annulus, the mandrel and packoff assembly comprising portions of this invention would be inserted into a well. The mandrel 10 is connected to the lower end of the production string 4 and mandrel 8 generally comprises a cylindrical member having a sealing surface 81 and a recess 82 adjacent its lower end. A downwardly facing shoulder 84 extends between mandrel sealing surface 81 and recess 82. In the preferred embodiment depicted in FIG. 1, mandrel 10 comprises the lowermost section of tubing string 4. In alternate embodiments of this invention, not shown specifically herein, additional portions of standard tubing could be inserted below the location of mandrel 10. The length of mandrel 10 would be determined by the extent of longitudinal movement of the tubing string anticipated in the particular oil well completion in which this assembly is to be used. Perhaps the most common applications in which this invention would be used would require a mandrel section on the order of 22 feet in length.

Packoff member 8 is initially carriable on mandrel 10. In the preferred embodiment of this invention, packoff member 8 is attached to mandrel 10 by means of an interconnection involving collet 70, shear pin 94, and guide member 96. Packoff member 8 is received around the outer periphery of mandrel 10 and, in the position shown in FIG. 1, packoff member 8 occupies the annular space between casing bore receptacle 6 and mandrel 10. Packoff member 8 comprises an upper body section 20 having a female left hand square thread 24 in its upper end 22. Cylindrical section 22 also has an enlarged downwardly facing no-go shoulder 26 on the outer surface at the upper end of cylindrical section 22. Enlarged downwardly facing no-go shoulder 26 has a downwardly facing annular shoulder or radially extending abutting means 28 at its lower end and, in the position shown in FIG. 1, downwardly facing shoulder 28 abuts upwardly facing shoulder 18 to prevent continued movement of packoff member 8 down the oil well past casing bore receptacle 6. Seal stacks 30 and 32 are shown on the outer and inner cylindrical surfaces of upper body member 20. These seal stacks comprise a plurality of chevron-shaped sealing members. Each seal stack is shown with three individual sub-assemblies of seal members facing in opposite directions. Although various conventional sealing assemblies could be employed with this invention, the particular sealing elements depicted in the preferred embodiments comprise a primary elastomeric sealing member which can provide adequate sealing integrity in the presence of high pressure differentials. For example, an elastomeric sealing member utilizing a perfluoroelastomer, such as the elastomer commonly referred to under the DuPont trademark "Kalraz", can be used effectively in this invention. Each individual seal subassembly also comprises two relatively rigid back up members 36A and 36B on opposite ends of elastomeric member 34. Back up members 36A and 36B can comprise a material formed generally of polyphenylene sulfide, commonly referred to under the Phillips Petroleum Corporation trademark "Ryton". An intermediate back up member 38 immediately adjacent to the convex surface of elastomeric member 34 is also shown in each seal assembly used in this invention. This intermediate back up member can comprise a member formed of polytetrafluoroethylene with glass filler material interspersed therein, commonly referred to as glass filled "Teflon", a trademark of DuPont Corporation. These chevron-shaped sealing assemblies do not require the application of a mechanical compressive force in order to energize the sealing elements, and such chevron-shaped members generally have a relatively small radial width. Metal spacer members 40 are also shown between adjacent seal subassemblies. A scraper member 46 is shown mounted on the inner surface of packoff upper body member 20. This scraper member would act to prevent the build up of sludge or other material on the outer surface of mandrel 10. Inner and outer seal stacks 32 and 30, as well as 54 and 52, are generally flush with the cylindrical surfaces of packoff member 8.

Packoff member 8 also comprises a lower body member 50 threadably engaged with upper body member 20 by means of threaded connection 48. An O-ring seal 56 is positioned along the interface between the lower surface of upper packoff body member 20 and lower packoff body member 50. Outer and inner seal assemblies 52 and 54, generally equivalent to seal assemblies 30 and 32, are mounted along lower packoff body member 50 and similarly provide sealing integrity between the polished bore 80 of casing bore 6, mandrel sealing surface 81, and the packoff member 8. A threaded extension 60 extends centrally from the lower portion of packoff body member 50 and has threaded connections 62 and 64 along opposite surfaces. The outer threaded connection 62 engages threaded connections on a collet member 70. The inner threaded connection 64 engages mating threads on seal retainer 68, which also holds a lower scraper member 66 similar to upper scraper member 46.

Figure 1B:
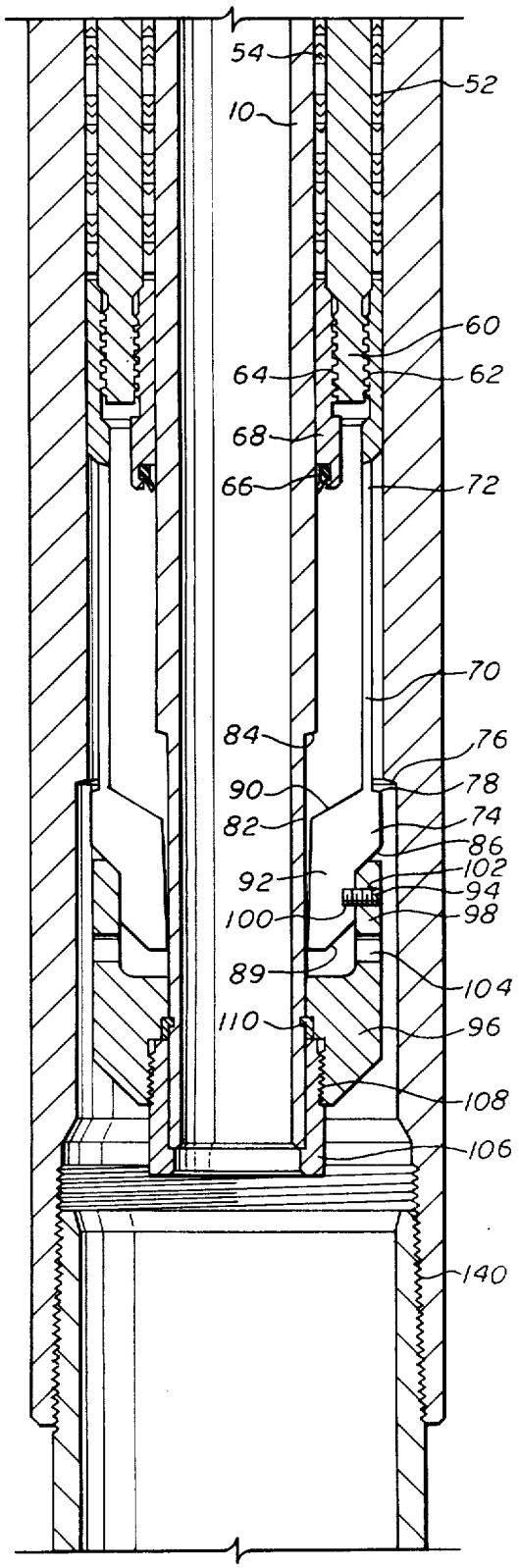
Figure 2:
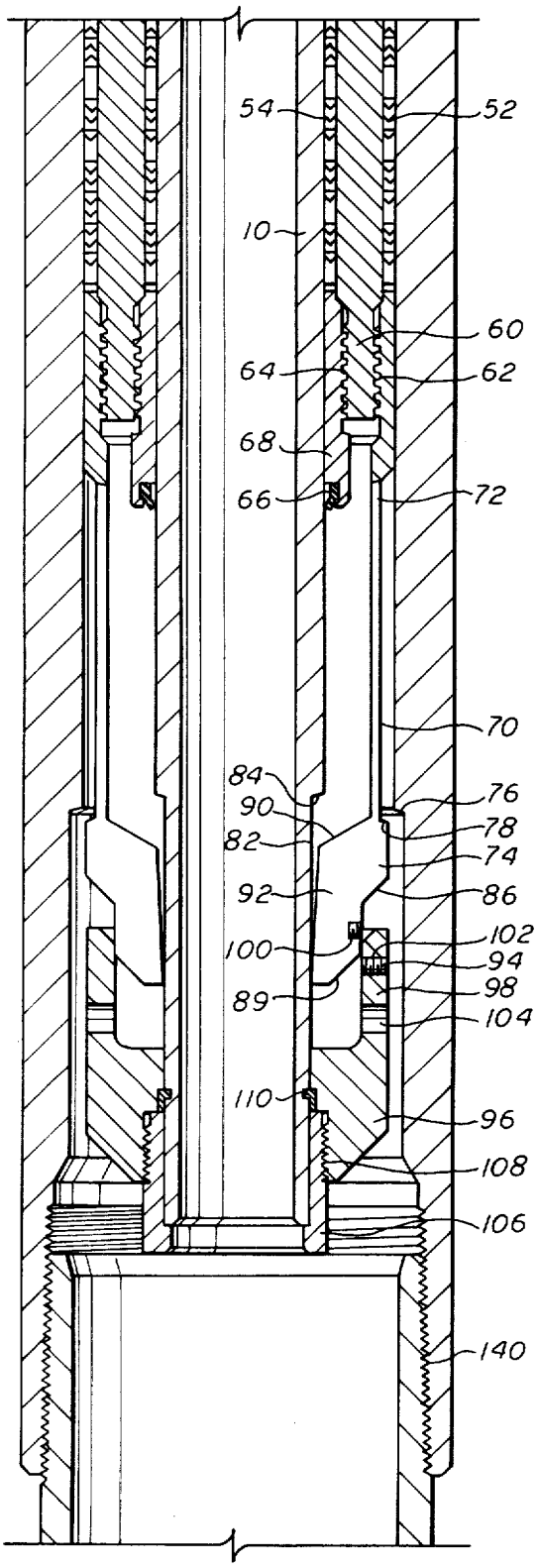
FIG. 2 depicts the shearing of a pin attaching the collet to the mandrel.
Figure 3:
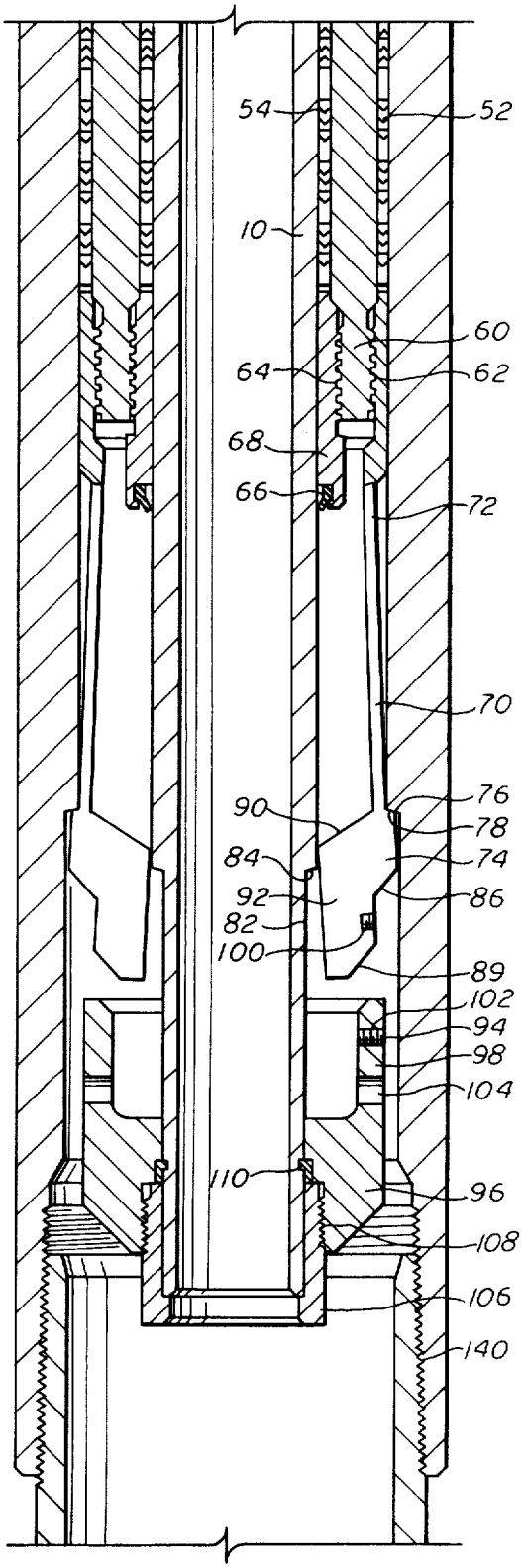
FIG. 3 shows the collet as it is cammed radially outward into engagement with the casing bore receptacle.

Collet 70 comprises a plurality of radially expanding collet head members 74 located along the lower end of arms 72 which together comprise a radially expandable latching means. Collet head 74 is shown in FIG. 1 just below and in the vicinity of casing downwardly facing shoulder 76. Collet head 74 is indirectly attached to mandrel 10. An outwardly extending and upwardly facing shoulder 78 is located on collet head 74 and, as can be seen in FIG. 3, shoulders 76 and 78 cooperate to limit upward movement of packoff member 8 relative to casing bore 76 when the packoff member is in the operating position. Collet head 74 also has an inclined downwardly facing surface or shoulder 86 on its exterior and spaced below upwardly facing shoulder 78. An upwardly facing shoulder 90 is located on the interior of collet head 74 immediately adjacent to arm 72. Collet head 74 is shear pinned to an upwardly extending skirt member 98 which comprises an integral part of a guide element 96. Skirt 98 also receives shear pin 94 through a hole 102 aligned with a similar hole 100 in the collet. A second hole 104 extends through guide skirt 98 below the location of shear screw 94. Holes 104 in the lower end of skirt 98 prevent debris from accumulating in the pocket formed by the skirt. Screw 94 has a predetermined shear strength. At the upper end of skirt 98 an upwardly facing shoulder 88 is shown abutting shoulder 86 in FIG. 1. Guide 96 is held in position relative to mandrel 10 by means of a retaining nut 106 which engages threads 108 on guide 96 and a shear ring 110 trapped between guide member 96 and retaining nut 106, which engages the outer surface of mandrel 10.

As packoff member 8 and mandrel 10 are inserted into an oil well containing a casing bore receptacle 6, no-go shoulders 18 and 28 will eventually abut preventing continued travel of packoff member 8. At this point, collet 70 may be released by continued downward movement of mandrel 10 causing shear pin 94, which comprises releasable means for attaching said collet to said mandrel, to be severed. The mandrel 10 is then free to continue movement down the well and guide skirt 98 will ultimately release collet head 74. Release of collet head 74 by guide skirt 98 occurs just prior to engagement of camming shoulder 84 on mandrel 10 with a separate surface 90 on collet head 74. A first camming action occurs when engagement of these surfaces cams collet 72 radially outward for abuttment between shoulder 78 and shoulder 76 on the casing bore receptacle. The base 92 of collet head 74 will then engage the outer surface 81 of mandrel 10. In this position collet head 74 is locked in its radially expanded position and packoff member 8 is fixed within casing bore receptacle 6. Collet head 74 must be forced outward by a cooperating surface on mandrel 10, because the spring force inherent in the collet would tend to return the collet to its inwardly retracted position. While collet head 74 has been forced outward by mandrel 10 into engagement with the casing bore receptacle, the mandrel is free to move relative to both the packoff member and the casing bore receptacle. When it becomes desirable to retrieve mandrel 10 and packoff member 8, mandrel 10 can be raised. Guide skirt 98 will engage collet head 74 and surface 88 will engage a cooperating camming surface 89 on the lower end of collet head 74, as part of a second camming action, to move collet head 74 radially inward. As skirt 98 cams collet head 74 radially inward, recess 82 on mandrel 10 will move into position below collet head 74 allowing the collet to move radially inward, thus releasing the packoff assembly for retrieval. If for some reason material has accumulated above packoff member 8 preventing retrieval of packoff member 8 and mandrel 10, guide member 96 can be released by continued pulling on mandrel 10. Eventually, shear ring 110 will be sheared allowing the tubing and mandrel 10 to be removed from the well. Guide members 96 and retaining nut will fall to the bottom of the well. Subsequently an appropriate retrieving tool can be inserted from the top of the well and material which may have accumulated above packoff member 8 may be removed. The retrieving tool can then engage left hand square threads 24 and the packoff member can then be retrieved. This retrieval of packoff member 8 will occur after tubing 4 and mandrel 10 have been removed from the well.

Figure 4:
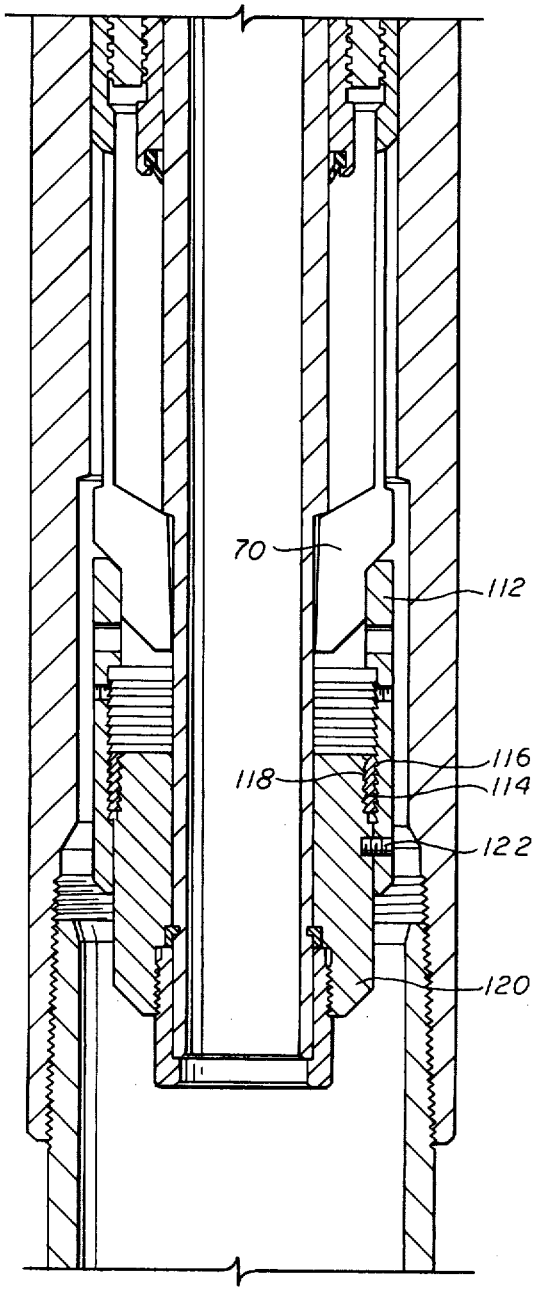
FIG. 4 is an alternate embodiment of the collet member designed to account for drag in deviated wells.
Figure 5:
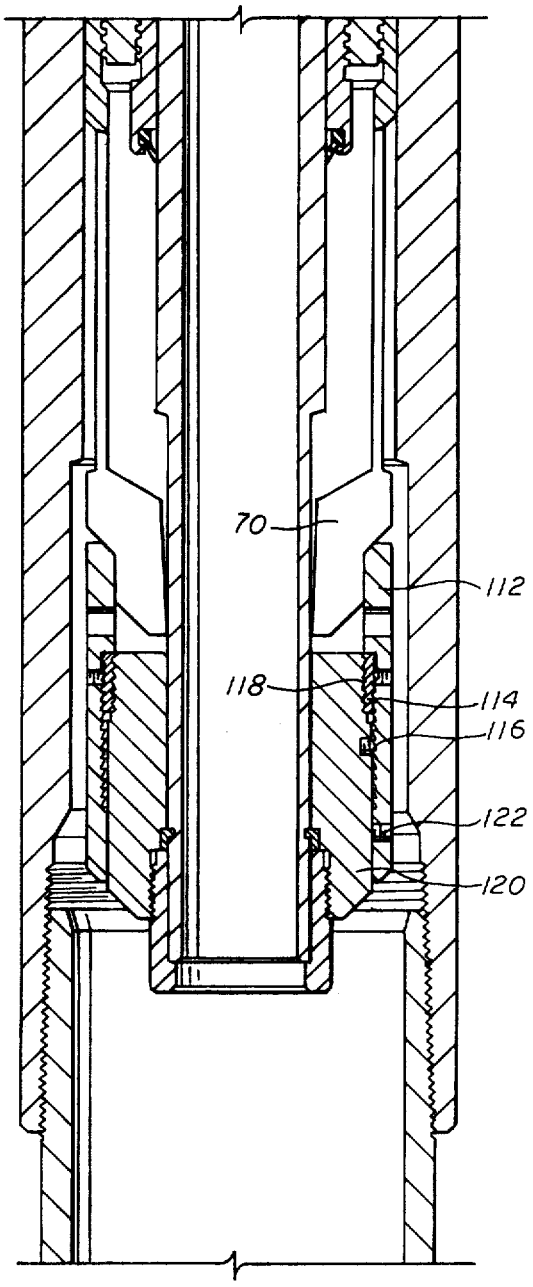
FIG. 5 depicts the upward movement of the mandrel and the telescoping of the guide relative to the drag skirt prior to engagement of the collet in the first alternate embodiment.

FIGS. 4 and 5 show an alternate embodiment of the collet and guide assembly which can also be utilized with this invention. This alternate collet arrangement is somewhat more complicated than that shown in FIG. 1, but it is especially adapted for use in deviated wells extending at an angle to the horizontal where the collet and skirt on the embodiment shown in FIG. 1 may be subjected to sufficient drag to shear the pin 94. In this embodiment, the collet 70 is fixed relative to shoulder 84 on the mandrel and any drag force exerted on the collet during insertion will be transmitted directly to mandrel 10. In the alternate embodiment of FIG. 4, a collet head identical to collet head 74 in FIG. 1 can be employed. In this embodiment, the pin 122 is sheared and the collet is released by pulling up on the tubing. Pressure is first conventionally applied within the tubing-casing annulus to hold the packoff member in position. A separate drag skirt 112, which engages the outer surface of collet member in the same fashion as the embodiment of FIG. 1, is employed in the embodiment of FIG. 4. An interconnecting body lock ring 114 which engages wickers 116 and 118 on the guide skirt and guide 120, respectively, is shown located on the inner surface of drag skirt 112. When packoff member 8 has reached the appropriate position in the well and when shoulders 28 and 18 prevent further travel of packoff member 8, collet release in FIG. 4 will be initiated by pulling up on mandrel 10. As mandrel 10 is pulled up, sufficient force will eventually be applied to shear the pin 122. When the guide 120 telescopes up within skirt 112, body lock ring 114 ratchets up to retain members 112 and 120 in this position. With the guide telescoped up within the drag skirt, subsequent downward movement of mandrel 10 will move drag skirt 112 releasing collet 90. Retrieval of packoff member 8 and mandrel 10 can be accomplished in the same fashion as with the embodiment of FIG. 1.

Figure 6:
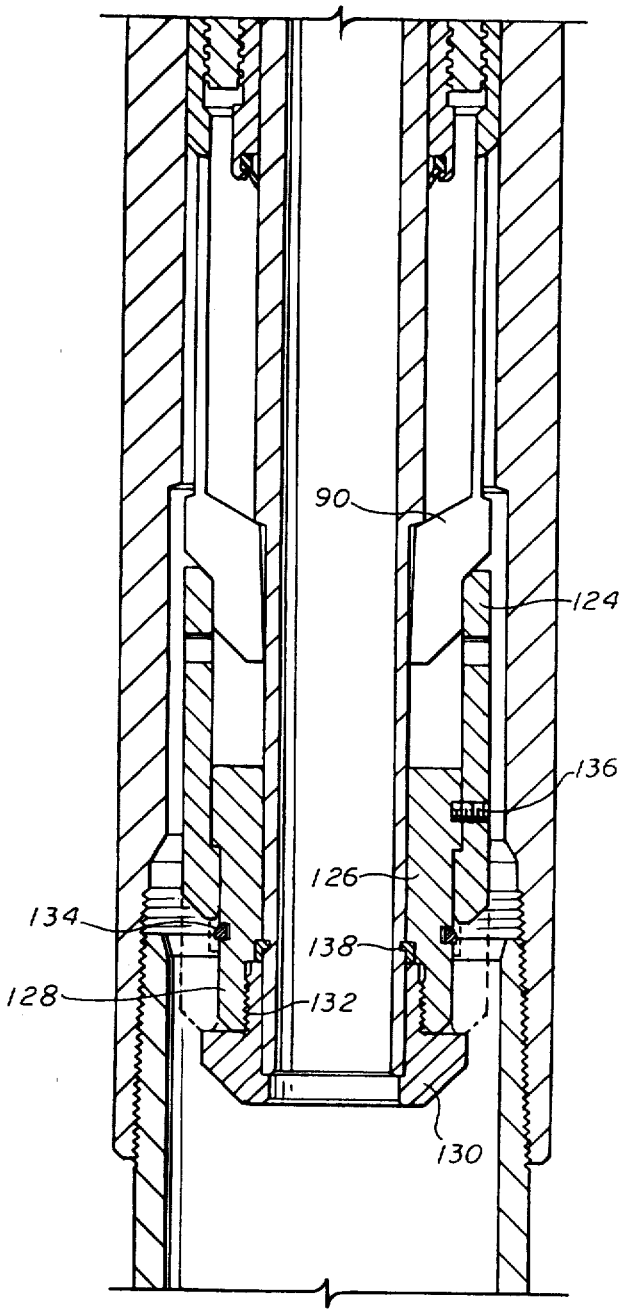
FIG. 6 shows still another alternate embodiment of the collet member which can be released by pulling up on the mandrel through the tubing.

Still another embodiment of the collet latching arrangement of this invention is illustrated in FIG. 6. Collet 9 and mandrel 10 are in the same configuration as shown in FIG. 4 with shoulder 84 abutting collet member 70. An upward force exerted on mandrel 10 will cause guide member 126 to move up. Sufficient upward force must be applied in order to shear pin 136. After pin 136 is sheared, shoulder 140 on skirt 124 will engage a slip ring 134 on guide member 126. Downward movement of mandrel 10 will then cause skirt 124, which now engages slip ring 134, to move down again allowing collet member 70 to be cammed outwardly by shoulder 84. Guide member 126 engages a lower retaining base 130 which is attached to mandrel 110 by means of threaded connection 132 and shear ring 138 much in the fashion of the embodiment shown in FIG. 1 and in FIG. 4.

OPERATION

The operation of the preferred embodiments of this invention should be generally apparent from the description of the elements of each embodiment and their respective functions. When this invention is to be employed in a subterranean oil or gas well, a casing bore receptacle 6 will be incorporated as an integral part of the subterranean well casing. When production is to begin, mandrel 10 will be incorporated as an integral component of the fluid transmission conduit or tubing string. A packoff member 8 will be releasably affixed to mandrel 10 and will encompass mandrel 10. It should be apparent that the thickness of annular packoff member 8 will be substantially equal to the spacing between the inner casing receptacle sealing bore surface 19 and the exterior of mandrel 10. The outer diameter of mandrel 10 is substantially equivalent to the outer diameter of tubing 4. In each of the preferred embodiments, the seal stacks 30, 32, 52, and 54 are substantially flush with the inner and outer circumferential surfaces of annular packoff member 8. When mandrel 10 is inserted into casing 2 on the end of tubing 4 the mandrel proceeds downward until it reaches the position occupied within the casing by casing bore receptacle bore 6. Continued movement of packoff member 8 is prevented by abuttment of shoulder 26 with shoulder 18 on casing bore receptacle 6. At this point, the annular packoff member 8 can be released from mandrel 10 by longitudinal movement of mandrel 10 relative to casing polished bore receptacle 6. Depending upon the releasable latching arrangement or collet arrangement utilized, upward or downward movement of mandrel 10 will shear the releasable latching member from mandrel 10. In the embodiment of FIG. 1, downward movement of mandrel 10 will release collet 70. In the other embodiments, upward movement of mandrel 10 is necessary before the release of collet 70. In these alternative embodiments the annulus between the tubing and the casing must first be pressurized in order to keep packoff member 8 stationary during the severing operation. After collet 70 has been freed from packoff member 8, downward movement of mandrel 10 will cause the collet to engage casing bore receptacle 6 as collet 70 is cammed outwardly by shoulder 84. The packoff member is now fixed relative to the casing bore receptacle and outer seal means 30 and 52 establish a static seal between packoff member 8 and casing bore receptacle 6. Mandrel 10 is free to move relative to packoff member 8 and one of the principal objectives of this invention is to provide a means in which movement of mandrel 10 is in response to the contraction and elongation of tubing 4. Seals 54 and 32 thus provide a dynamic seal with mandrel 10. When tubing 4 is to be removed from the well, collet 70 may be released from engagement with shoulder 76 on casing bore receptacle 6 utilizing the camming arrangements discussed with respect to each of the embodiments depicted herein. Packoff member 8 and mandrel 10 can then be removed from the well, leaving casing bore receptacle 8 intact.

The guide means in each of the embodiments of this invention is connected to the mandrel through a shear ring 110. The presence of this shear ring provides a means of releasing the guide means from the mandrel if the packoff member 8 is lodged relative to the casing bore receptacle 6 by the accumulation of debris in the annulus above packoff member 8. In such a case, the tubing can be retrieved by exerting an additional upward force on the tubing. Since the packoff member is, under these conditions, trapped, the additional upward force on the tubing will be transmitted through the mandrel 10 and this force will cause shear ring 110 to be severed. The tubing and the mandrel can then be withdrawn from the well leaving the packoff assembly intact. The guide member will then fall to the bottom of the well.

Although the invention has been described in terms of specified embodiments which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A sealing assembly for establishing sealing integrity in an annular area between a movable fluid transmission conduit and the casing of a subterranean well above a production zone, said assembly comprising:

a casing bore receptacle incorporable in said casing above said production zone, and comprising a casing receptacle sealing bore having a diameter less than the diameter of said casing;

a mandrel incorporable in said fluid transmission conduit;

an annular packoff member having inner and outer axially extending circumferential surfaces, said annular packoff member being insertable between said casing bore receptacle and said mandrel and being releasably carriable on said mandrel;

means on said annular packoff member comprising radially expandable latching means for engaging said casing bore receptacle to prevent movement of said annular packoff member relative to said casing bore receptacle in first and second opposite longitudinal directions;

disengagable means for attaching said annular packoff member to said mandrel and for releasing said annular packoff member from said mandrel after engagement of said annular packoff member with said casing bore receptacle to permit said mandrel to move relative to said annular packoff member in said first and second longitudinal direction said disengagable means comprising means for retaining said radially expandable latching means in a retracted position; and inner and outer sealing means circumferentially extending along the inner and outer surface of said annular packoff member for establishing sealing integrity between said mandrel and said annular packoff member and between said casing receptacle sealing bore and said annular packoff member.

2. A sealing assembly for establishing sealing integrity in the annular area between a movable fluid transmission conduit and the casing of a subterranean well above a production zone, said assembly comprising:

a casing bore receptacle incorporable in said casing above said production zone, and comprising a casing sealing bore having a diameter less than said casing and first and second oppositely facing stops;

an annular packoff member having sealing means on the inner and outer cylindrical surfaces thereof, said outer seal means for establishing sealing integrity along casing sealing bore;

a mandrel incorporable in said fluid transmission conduit, said annular packoff member being initially carriable on said mandrel, and said inner sealing means being for establishing sealing integrity along said mandrel;

means on said packoff member for engaging said first stop on said casing bore receptacle to prevent movement of said packoff member in a first longitudinal direction;

a radially expandable latching means on said packoff member for engaging said second stop on said casing bore receptacle to prevent movement of said packoff member in a second opposite longitudinal direction;

first camming means on said mandrel for camming said said radially expandable means radially outward upon movement of said mandrel in said first longitudinal direction; and a second camming means extending from said mandrel for camming said radially expandable means radially inward upon movement of said mandrel in said second direction.

3. The sealing assembly of claim 2 wherein said first and second stops comprise oppositely facing first and second shoulders.

4. The sealing assembly of claim 3 wherein said casing sealing bore extends between said first and second shoulders.

5. The sealing assembly of claim 2 wherein said sealing means comprises sealing elements having a chevron-shaped cross section.

6. The sealing assembly of claim 5 wherein said sealing elements comprise elastomeric elements.

7. The sealing assembly of claim 2 wherein said sealing means comprise a plurality of stacked sealing elements.

8. The sealing assembly of claim 2 wherein said means on said packoff member for engaging said first stop comprises a radially extending downwardly facing annular shoulder.

9. The sealing assembly of claim 2 wherein said radially extending latching means comprises a collet.

10. The sealing assembly of claim 9 further comprising a radially inwardly extending recess on said mandrel.

11. The sealing assembly of claim 10 wherein said collet is initially attached to said mandrel in a radially inward position, said collet being partially received within said recess.

12. The sealing assembly of claim 11 wherein said collet is attached to said mandrel by shear means having a predetermined shear value.

13. The sealing assembly of claim 12 wherein said mandrel is movable in said first longitudinal direction relative to said casing bore receptacle after said radially extending abutting means engages said first stop upon application of a shear force to said pin greater than said predetermined shear value.

14. The sealing assembly of claim 13 wherein said first camming means comprises a shoulder on said mandrel adjacent one end of said recess.

15. The sealing assembly of claim 14 wherein said second camming means is attached to said mandrel by means of a shear ring engaging said mandrel in said recess.

16. A sealing assembly adapted to isolate the annular area thereabove between a fluid transmission conduit and the casing in a subterranean well from a production zone therebelow, said seal assembly comprising:

a casing bore receptacle incorporable in said casing and having a casing sealing bore thereon;

a tubular mandrel incorporable on said fluid transmission conduit having a radially inwardly extending recess therein and a downwardly facing shoulder adjacent one end of said recess;

a packoff member initially carriable on said tubular mandrel and having inner and outer sealing elements for establishing sealing integrity with said casing and said mandrel, and an annular shoulder having an outer diameter greater than the inner diameter of said casing sealing bore, said shoulder abutting said casing bore receptacle to prevent continued movement thereof in a first longitudinal direction past said casing bore receptacle;

a radially expandable collet on said packoff member, said collet being initially releasably affixed to said mandrel in a retracted position with said collet being received within said recess, said collet being releasable upon movement of said mandrel with said packoff member held stationery relative to said casing bore receptacle, said collet upon radial expansion engaging said casing bore receptacle as said shoulder on said mandrel engages said collet to cam said collet radially outward; and camming retraction means on said mandrel for camming said collet radially inwardly upon movement of said mandrel relative to said packoff member in a direction opposite said first longitudinal direction.

17. The sealing assembly of claim 16 wherein said annular shoulder prevents continued movement of said packoff member in said first longitudinal direction and said collet is released from said mandrel upon continued movement of said mandrel in said first direction.

18. The sealing assembly of claim 17 wherein said shoulder on said mandrel is spaced from said collet when said collet is affixed to said mandrel.

19. The sealing assembly of claim 16 wherein said shoulder on said mandrel abuts said collet when said collet is affixed to said mandrel.

20. The sealing assembly of claim 19 wherein said collet is released from said mandrel after movement of said mandrel relative to said packoff member in the direction opposite said first longitudinal direction.

21. The sealing assembly of claim 20 wherein a longitudinally extending guide member spaced from said mandrel is affixed to said mandrel, said guide member abutting said collet to retain said collet in the retracted position.

22. The sealing assembly of claim 21 further comprising shear means interconnecting said collet and said mandrel.

23. The sealing assembly of claim 22 wherein said shear pin is sheared upon movement of said mandrel in the direction opposite said first longitudinal direction, and further comprising a ratcheting means for engaging said guide member preventing movement of said mandrel in said first direction relative to said guide but allowing relative movement thereof in the direction opposite said first direction.

24. The sealing assembly of claim 16 further comprising shear means between said mandrel and said camming retraction means, said shearing means releasing said camming retraction means from said mandrel by a longitudinal force exerted through said mandrel.

25. A method of producing fluids in a subterranean well through a fluid transmission conduit insertable within an outer well casing, and for establishing sealing integrity in the annular area between said fluid transmission conduit and said casing and above said production zone, said method comprising the steps of:

incorporating a casing bore receptacle in said casing above said production zone;

incorporating a mandrel in said fluid transmission conduit with an annular packoff member releasably affixed to said mandrel, said annular packoff member having seals on the interior and exterior thereof;

inserting said fluid transmission conduit into said casing;

positioning said annular packoff member with said seals on the exterior thereof in contact with said casing bore receptacle;

engaging said annular packoff member with said casing bore receptacle to prevent longitudinal movement in a downward longitudinal direction;

increasing the pressure within the annulus between said fluid transmission conduit and said casing to increase the force acting on said annular packoff member in an upward direction;

moving said mandrel in an upward direction after increasing the pressure within said annulus to release said annular packoff member from said mandrel; and engaging said annular packoff member with said casing bore receptacle upon movement of said mandrel in a downward direction to prevent longitudinal movement of said annular packoff member relative to said casing bore receptacle in said upward direction with said seals on the interior of said annular packoff member maintaining sealing integrity as said mandrel moves therein.

26. A sealing assembly for establishing sealing integrity in an annular area between a movable fluid transmission conduit and the casing of a subterranean well above a production zone, said assembly comprising:

an annular packoff member initially carriable on a tubular section incorporated in said fluid transmission conduit and having inner and outer sealing elements for establishing sealing integrity with said casing and said tubular section, said annular packoff member having downwardly facing shoulder means for abutting an upwardly facing shoulder on said casing to prevent further downward movement of said packoff member;

at least one initially retracted expandable latching member, carried by said packoff member and initially engaging said tubular section to prevent downward movement of said tubular section relative to said latching member and said packoff member;

a guide skirt member spaced from said tubular section and initially holding said latching member in a retracted position, said guide skirt member being interconnected to said tubular section by interconnecting means preventing downward movement of said tubular section relative to said guide skirt member and permitting limited upward movement of said tubular section relative to said guide skirt member, said latching member being released by upward movement of said tubular section relative to said guide skirt member followed by downward movement of said tubular section and said guide skirt member relative to said latching member and said packoff member; and camming means on said tubular section for radially expanding said latching member upon downward movement of said tubular section following limited upward movement of said tubular section.

27. The sealing assembly of claim 26 wherein said interconnecting means comprises ratcheting means.

28. The sealing assembly of claim 27 wherein said ratcheting means comprises a body lock ring in ratcheting engagement with wicker threads on said guide skirt member.

29. The sealing assembly of claims 26, 27 or 28 further comprises shear means interconnecting said latching member and said mandrel.

30. The sealing assembly of claim 26 wherein said latching member comprises a collet.

31. The sealing assembly of claim 26 wherein said camming means comprises a downwardly facing camming shoulder on said tubular section, said camming shoulder initially abutting said latching member when in the retracted position to prevent downward movement of said tubular section relative to said latching member and said packoff member.

32. The sealing assembly of claim 26 wherein said interconnecting means comprises an upwardly facing shoulder on said guide skirt member engaging a downwardly facing shoulder affixed to said tubular section and an expandable ring member engagable with said upwardly facing shoulder after limited upward movement of said tubular section.

* * * * *